US005549537A

United States Patent [19]

Focke et al.

[11] Patent Number: 5,549,537

[45] Date of Patent: Aug. 27, 1996

[54] APPARATUS FOR THE SHAPING TREATMENT OF BLANKS, ESPECIALLY FOR HINGE-LID PACKS

[75] Inventors: Heinz Focke; Helmut Granz, both of Verden, Germany

[73] Assignee: Focke & Co. (GmbH & Co.), Verden, Germany

[21] Appl. No.: 386,627

[22] Filed: Feb. 10, 1995

[30] Foreign Application Priority Data

Feb. 11, 1994 [DE] Germany ..... 44 04 289.2

[51] Int. Cl.[6] ..... B31B 3/28

[52] U.S. Cl. ..... 493/162; 493/176

[58] Field of Search ..... 493/416, 442, 493/450, 451, 459, 465, 910, 911, 968, 405, 180, 182, 162, 295, 163, 175, 176

[56] References Cited

U.S. PATENT DOCUMENTS

| | | |
|---|---|---|
| 2,609,736 | 9/1952 | Montgomery . |
| 3,514,097 | 5/1970 | Hoff . |
| 4,469,542 | 9/1984 | Reil . |
| 4,708,704 | 11/1987 | Focke et al. . |
| 5,184,998 | 2/1993 | Volk et al. . |

FOREIGN PATENT DOCUMENTS

| | | |
|---|---|---|
| 3805050 | 10/1988 | Germany . |
| 3515775 | 7/1990 | Germany . |
| 4209141 | 9/1993 | Germany . |
| 1381847 | 1/1965 | United Kingdom . |

*Primary Examiner*—Jack W. Lavinder

*Attorney, Agent, or Firm*—Sughrue, Mion, Zinn, Macpeak & Seas

[57] ABSTRACT

In the production of hinge-lid packs with especially rounded longitudinally edges (11, 12) a blank (14) is pre-shaped in the region of a shaping station (18). To this end, the regions of the longitudinal edges (11, 12) of the blank (14) are pressed against shaping margins (23, 24) of a shaping plate (20) by shaping rollers (21, 22). To increase the performance of the shaping station (18), the shaping rollers (21, 22) are moved back into the starting position along a path of movement (29) which is located at a distance from the shaping plate (20). During this movement back into the starting position, the pre-shaped blank (14) can be discharged and a following blank can be moved into position.

3 Claims, 3 Drawing Sheets

APPARATUS FOR THE SHAPING TREATMENT OF BLANKS, ESPECIALLY FOR HINGE-LID PACKS

BACKGROUND OF THE INVENTION

The invention relates to an apparatus for shaping or pre-shaping blanks for packs, especially hinge-lid packs with rounded or polygonal longitudinal edges, wherein the blanks can be fed to a shaping station having at least one shaping device comprised of a shaping plate with shaping longitudinal margins and movable shaping tools, especially shaping rollers, the movable shaping tools being movable along marginal regions of the shaping plate, especially from the bottom side of the shaping plate to the top side, thereby deforming the blank.

Hinge-lid packs are a widespread pack type for cigarettes. Recently, hinge-lid packs for cigarettes whose longitudinal edges have a rounded, beveled or polygonal design have been increasingly used. The production of such packs requires a preparatory treatment of the blanks, specifically a deformation of the same in the region of longitudinal edges. An example for an apparatus for shaping or pre-shaping blanks for hinge-lid packs is shown and described in U.S. Pat. No. 4,708,704 Focke et al (assigned to the assignee of the present application).

SUMMARY OF THE INVENTION

The present invention relates to a development or improvement of the apparatus according to U.S. Pat. No. 4,708,704, or similar shaping apparatuses for blanks.

The invention is based on the object to design an apparatus of the foregoing type in such a manner that a higher performance is attained when shaping or pre-shaping the blanks.

To attain this object, the apparatus according to the invention is characterized in that the movable shaping tools, especially shaping rollers, after carrying out a forming motion cycle, can be laterally lifted off the shaping plate and moved back into the starting position along a path of movement extending at a distance from the shaping plate.

Whereas in the state of the art according to U.S. Pat. No. 4,708,704, the shaping tools, specifically the shaping rollers, carry out an up and down movement in the region of the laterally rounded or trapezoidal shaping margins, the shaping tools, according to the invention, are moved out of the region of the shaping plate after completion of a forming working cycle, and moved back into the (lower) starting position at a significant distance from the shaping plate. Thereby, plenty of time is saved. When the shaping rollers are lifted off from the shaping plate in the upper position, the blank which has been processed by pre-shaping can already be discharged, and a following, unprocessed blank can be moved into the starting position. The advantage is in a significantly reduced cycle time of the shaping station.

For actuating the shaping rollers, a mechanical gearing comprised of a toggle lever for the shaping rollers, which is mounted pivotably and so as to be movable up and down, and two actuating drives, which take effect in a manner adapted to one another, are provided. This results in different paths of movement of the shaping tools during the working cycle, which preferably extends from the bottom to the top, on the one hand, and during the return into the starting position, on the other.

Further details of the apparatus according to the invention are explained hereinbelow with reference to the drawings, in which

DESCRIPTION OF A PREFERRED EMBODIMENT

Figure 1:
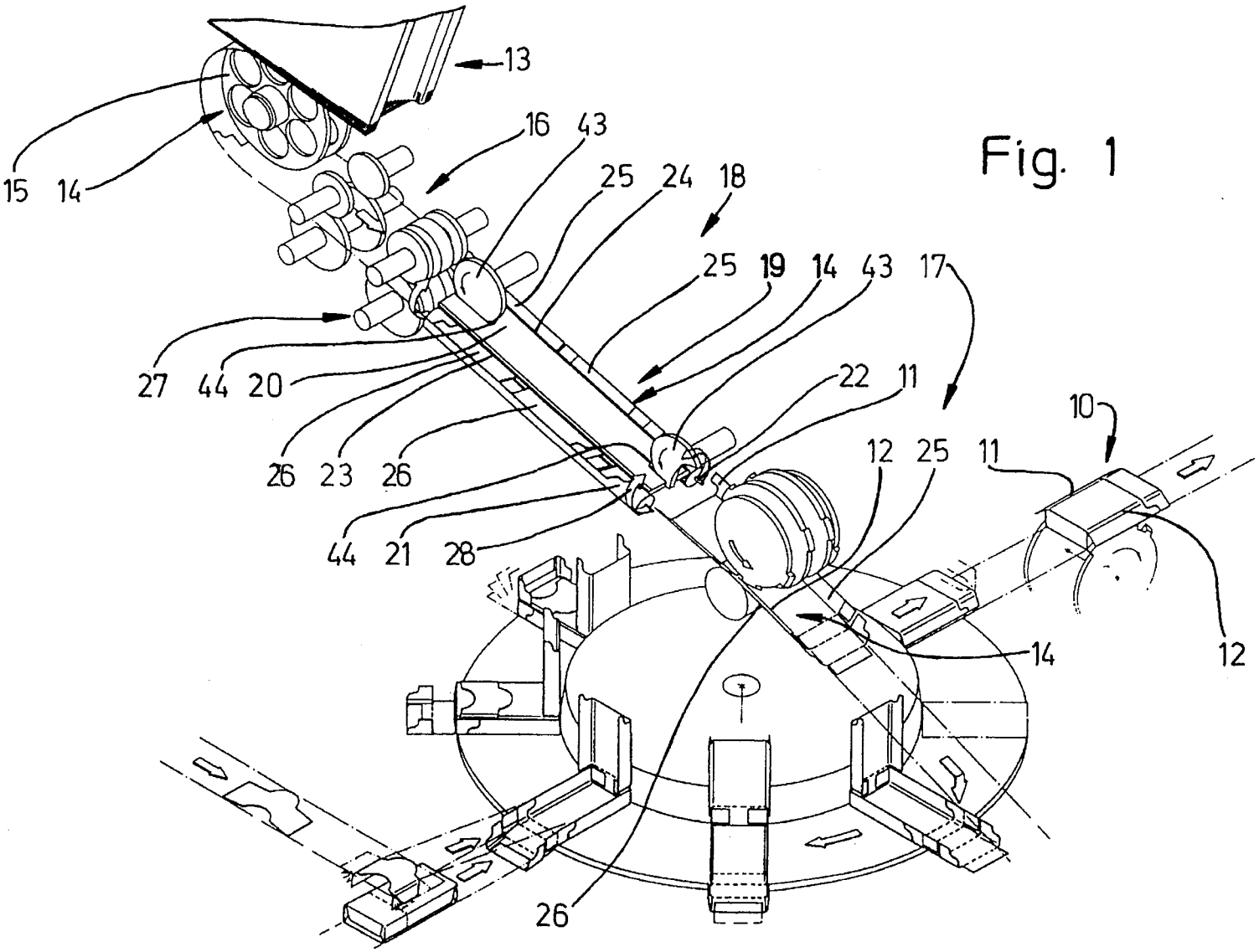
FIG. 1 shows a diagrammatic representation of a portion of a packaging machine for hinge-lid packs.

The exemplary embodiment shown in the drawings relates to the production of hinge-lid packs 10 whose forward and/or rearward longitudinal edges 11, 12 are rounded. Thereby, a hinge-lid pack with the design according to U.S. Pat. No. 4,753,383 is formed.

For the production of such hinge-lid packs 10, unfolded blanks 14 are successively withdrawn from the bottom side of a conventional blank magazine 13. In the present embodiment, a roll-off device 15, which is conventional in practice, is active for this purpose.

After leaving the blank magazine 13, the blanks 14 are moved into a blank track 16. This blank track 16 leads to a folding turret 17, in the region of which the hinge-lid packs are largely completed and filled. The folding turret 17 may be designed in the manner described in U.S. Pat. No. 4,084,393.

A shaping station 18 is arranged upstream of the folding turret 17 in the region of the blank track 16. In the region of the shaping station 18, the longitudinal edges 11, 12, in the region of the otherwise flat, unfolded blank, are pre-shaped in the manner of a chamfer. The pre-shaped blank is then fed to the folding turret 17 on the blank track 16 and further processed in the usual manner.

The shaping station 18 is provided with at least one shaping device 19. This shaping device 19 is comprised of one stationary shaping tool, specifically a shaping plate 20, and two movable shaping tools, specifically shaping rollers 21 and 22. The shaping plate 20 is designed with shaping margins 23, 24 extending in the lateral direction which correspond to the contour of the longitudinal edge 11, 12 to be produced. In the present case, the shaping margins 23, 24 are thus round. The shaping plate 20 is adapted to the dimensions of the blank 14. Lateral regions of the same laterally project from the shaping plate 20 in the starting position. These lateral regions are side tabs 25, 26 which are conventional in a blank 14 for hinge-lid packs 10. These side tabs are pressed against the shaping margins 23, 24 when pro-shaping the blank so that, in the region between the side tabs 25 and 26, on the one hand, and a central region of the blank 14, the rounded edges 11 are formed.

Figure 2:
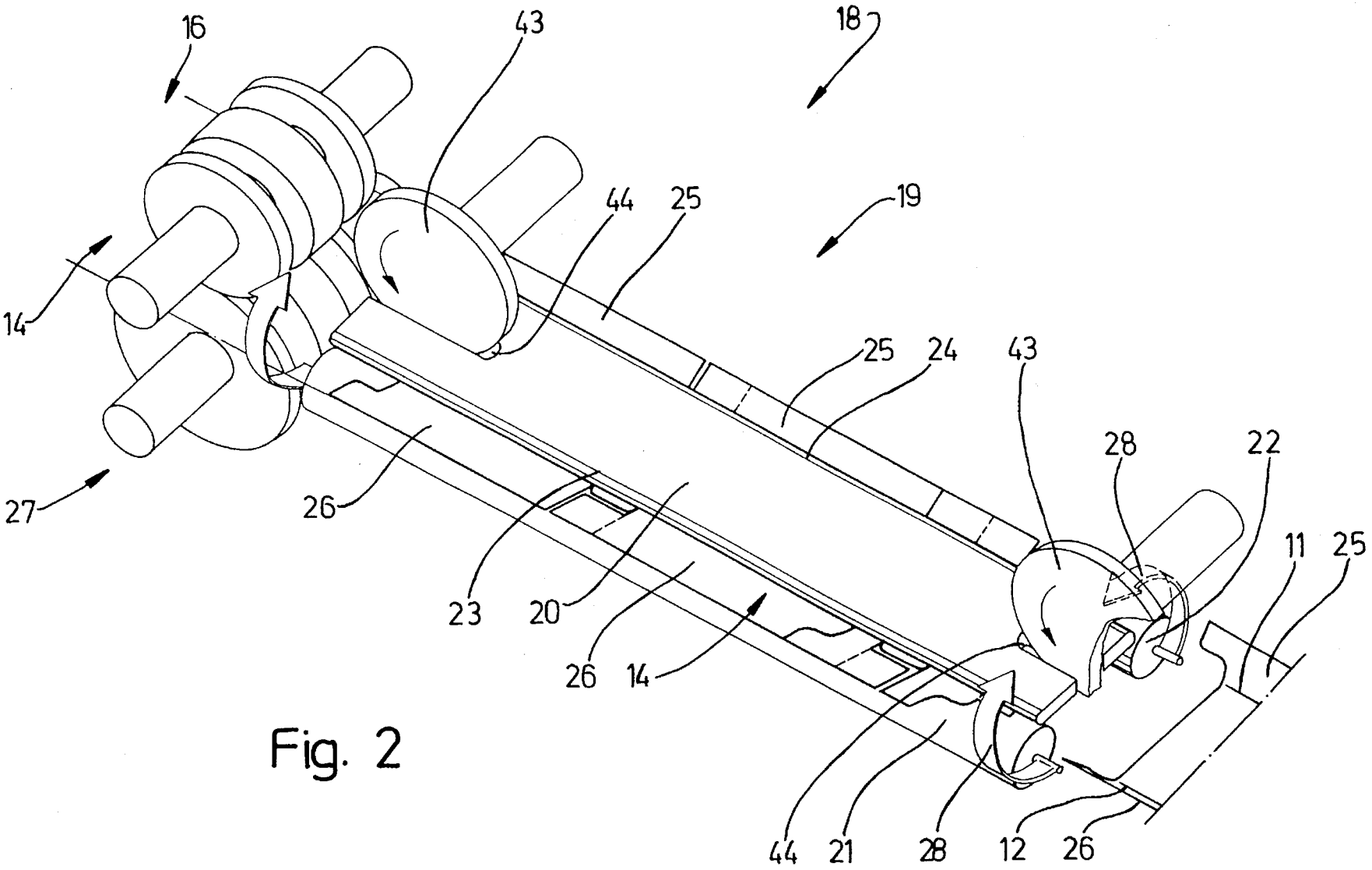
FIG. 2 shows a shaping station as a part of the apparatus according to FIG. 1, on an enlarged scale, also in a perspective view.

In the present exemplary embodiment, the blank 14 is transported into the shaping station 18 on the blank track 16 by means of transport rollers 27, specifically in such a manner that the blank 14 rests below the shaping station 20. The blank is pressed against the bottom side of the shaping plate 20 by means of appropriate holding members, especially suction bores (not shown). The blank 14 thereby assumes the position shown in FIGS. 2 and 3.

In order to ensure an accurate positioning of the blank during the transfer to the shaping plate 20, conveying discs 43 are assigned to the shaping plate 20. In the present case these are arranged on the shaping plate 20 itself. The conveying disc 43, with a lower region, enters into a longitudinal slot 43 at the end of the shaping plate 20. The conveying disc 43 interacts with an additional conveying disc (not shown) arranged below the shaping plate 20. One of the conveying discs 43 is arranged within close proximity of the transport rollers 27. Thus, for the transfer of the blank 14 to the shaping plate 20, the blank is guided by a plurality of members.

Now the shaping rollers 21, 22 take effect. These shaping rollers are located in a starting position below the blank 14. The shaping rollers 21, 22 are now moved along a first circular path of movement 28 along the contour of the shaping margins 23, thereby taking along the projecting parts of the blank 14, up to an upper position shown in dot-dash lines in FIG. 3. Thereby, the regions of the longitudinal edges 11, 12 are adjoined to the shaping margins 23, 24 under pressure.

After this forming working cycle, the shaping rollers 21, 22 return to their starting position, specifically below the shaping plate 20. Thereby, the shaping rollers are moved along a path of movement 29. This is chosen such that the shaping rollers 21, 22 are moved sideways from an upper final position, and then downwards, and finally back into the starting position. As a result of the lateral movement of the shaping rollers 21, 22, they are entirely moved out of the region of the shaping plate 20 or the blank 14. Immediately after completion of the forming working cycle, the deformed blank 14 can thus be discharged, and a new, flat blank 14 can be supplied. This blank can already be located in the working position according to FIG. 2 when the shaping rollers 21, 22 reach the starting position (continuous lines in FIG. 3).

The movement of the shaping rollers 21, 22 along the differently designed paths of movement 28, 29 is achieved by means of a special gearing. According to the exemplary embodiment of FIG. 3, the shaping rollers 21, 22 are arranged on the upper, free end of an upright leg 31. A lifting drive 33 takes effect on a leg 32, which is horizontally directed in a starting position. This lifting drive 33, in the present case, is comprised of a linkage 34 which is essentially movable up and down and which is hingedly connected to the free end of the leg 32, on the one hand, and to the actuating lever 35, on the other. The latter is moved up and down in a pivoting manner in the vertical plane.

Figure 3:
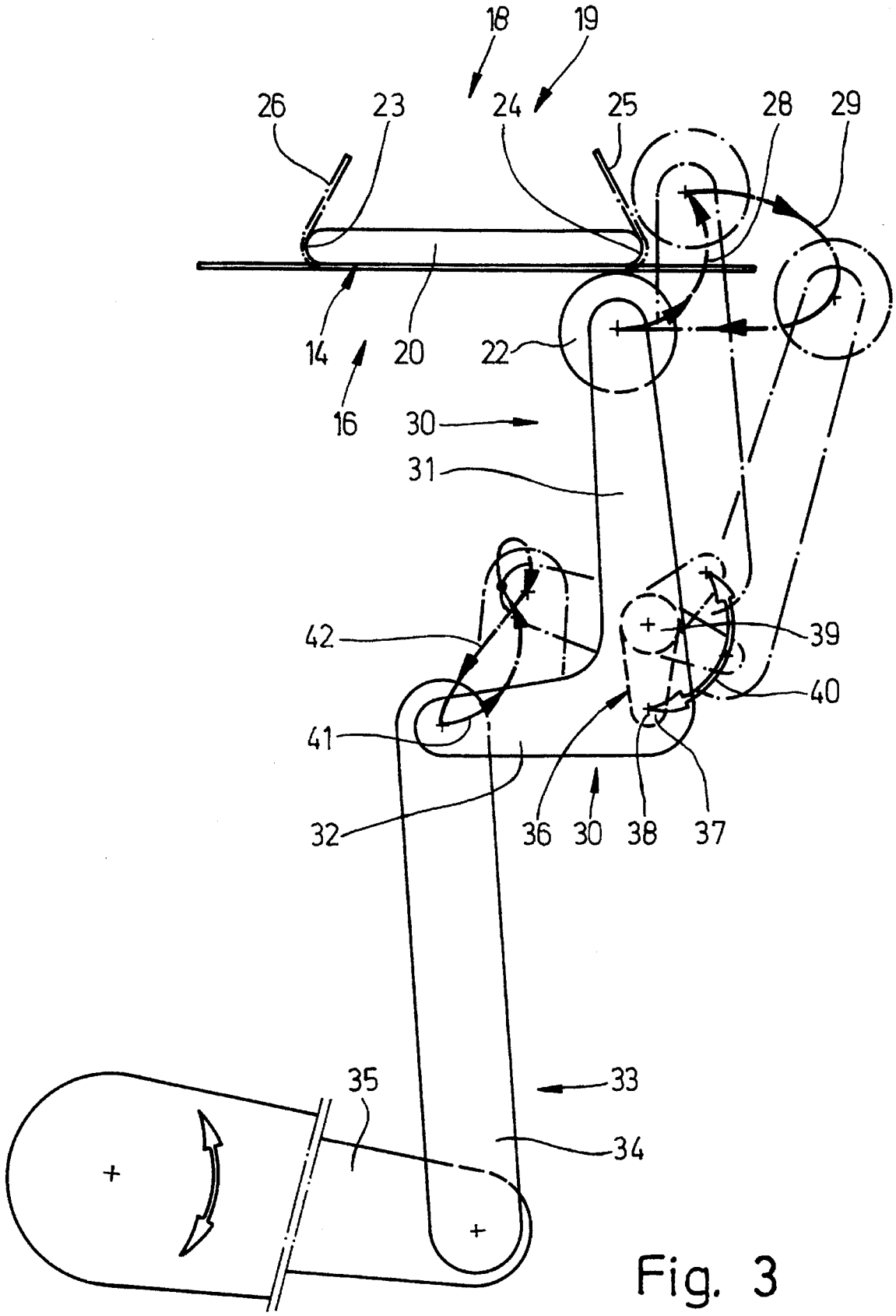
FIG. 3 shows a cross-sectional view of FIG. 2 with an actuating gear for shaping tools.

The complex, superposed movement of the shaping rollers 21, 22 along a path of movement 28, 29 is achieved by the method of operation of another gearing which in this case is designed as a crank 36 with a crank arm 37. The crank 36, in the representation according to FIG. 3, is concealed behind toggle lever 30. This toggle lever 30 is connected to the crank arm 37 in the region of the pivot bearing 38, the pivot bearing 38 being located in the region of the juncture of the two legs 31, 32. A stationary crankshaft 39 is located above.

The gearing formed by the crank 36 is in the first line responsible for the lateral movements of the shaping rollers 21, 22. This movement is superposed by the upward movement of the linkage 34. The crank arm 37 carries out a to and fro movement in the vertical plane, which is marked by an arrow of movement 40. The juncture between the linkage 34 and the leg 32, specifically a pivot bearing 41, thereby moves along a complex path of movement 42 which has approximately the shape of an "8".

Further constructive details of the shaping station may be designed according to U.S. Pat No. 4,708,704. This especially applies to the conveying members for the discharge of the blanks. The movement of the shaping tools, specifically of the shaping rollers 21, 22, may also be effected in the opposite direction. In this case, the blank 14 is positioned on the upper side of the shaping plate.

We claim:

1. An apparatus for shaping or pre-shaping blanks (14) for enclosed boxes with rounded or polygonal longitudinal edges (11, 12), said apparatus comprising:

a) a shaping station having at least one shaping device (19); and b) means for feeding the blanks (14) along a track (16) in a conveying direction into said shaping station (18) so that the longitudinal edges (11, 12) of the blank extend in the conveying direction of the blank (14) and are shaped by said shaping device (19);

c) wherein said shaping device (19) comprises: a stationary shaping plate (20) and two movable longitudinally extending shaping rollers (21, 22), the shaping plate (20) having shaping longitudinal margins (23, 24) with a contour corresponding to the shape of the longitudinal edges (11, 12) of each blank, the shaping rollers being parallel to the longitudinal margins (23, 24); and means for moving the shaping rollers from one position, which is beneath the blank (14) and in which the shaping rollers are pressed against the blank along the longitudinal margins (23, 24), to an upper side of the shaping plate (20) and then back to a starting position; and d) means for moving the shaping rollers (21, 22), after a shaping cycle has been carried out, from an end position above the shaping plate (20) along an arcuate path of motion (29), then laterally, and then for returning the shaping rollers (21, 22) to the starting position located beneath the shaping plate (20), so that the path of motion (29) along which the shaping rollers (21, 22) are returned runs outside of an area of the unshaped, flat blank (14).

2. The apparatus according to claim 1, comprising:

a lifting drive (33) for moving each shaping roller (21, 22); and at least one two-armed angled toggle-lever (30) to which each shaping roller (21, 22) is attached;

wherein the angled lever (30) has a free shank (32) connected to the lifting drive (33);

wherein said lifting drive comprises an actuating lever (35), pivotally mounted for up and down movement in a vertical plane, and a linkage (34) which is connected to one side of the actuating lever (35) and on another side to one (32) of two legs (31, 32) of the angled lever (30);

wherein the angled lever (30) is pivotally mounted to a pivot bearing (38) located at a juncture of the two legs (31, 32) of the angled lever; and wherein the angled lever (30), along with its pivot bearing (38), is connected to a free end of a crank arm (37) of a fixedly positioned crank (36), said crank arm rotating around a stationary crank shaft bearing (39).

3. An apparatus according to claim 1, further comprising conveying discs (43), wherein the blanks (14) are conveyed out of the shaping station (18) in the conveying direction, after shaping by the shaping rollers (21, 22), and during the return to the lower starting position, by said conveying discs (43) which are located in longitudinal slots (44) of the shaping plate and act in rearward and forward end regions of the shaping plate (20), relative to the conveying direction, and which grip the blank (14) in a central area thereof in a perpendicular direction and discharge the blank.

* * * * *